US006146183A

United States Patent [19]

Jinno et al.

[11] Patent Number: 6,146,183

[45] Date of Patent: Nov. 14, 2000

[54] LOCK STRUCTURE

[75] Inventors: Keishi Jinno; Shigeru Tanaka, both of Shizuoka, Japan

[73] Assignee: Yazaki Corporation, Tokyo, Japan

[21] Appl. No.: 09/438,261

[22] Filed: Nov. 10, 1999

[30] Foreign Application Priority Data

Nov. 10, 1998 [JP] Japan ..... 10-318755

[51] Int. Cl.[7] ..... H01R 13/627

[52] U.S. Cl. ..... 439/358

[58] Field of Search ..... 439/358, 357, 439/350, 488, 352, 353, 354, 355, 356, 140

[56] References Cited

U.S. PATENT DOCUMENTS

| | | | |
|---|---|---|---|
| 5,234,356 | 8/1993 | Maejima et al. | 439/352 |
| 5,624,271 | 4/1997 | Childs et al. | 439/352 |
| 5,624,272 | 4/1997 | Ohsumi | 439/353 |
| 5,692,681 | 12/1997 | Steinhauser et al. | 439/358 |
| 5,762,514 | 6/1998 | Long et al. | 439/358 |
| 5,839,002 | 11/1998 | Ito et al. | 439/358 |
| 5,938,470 | 8/1999 | Kashiyama | 439/489 |

FOREIGN PATENT DOCUMENTS

| | | | |
|---|---|---|---|
| 61-60482 | 4/1986 | Japan | H01R 13/639 |
| 2-541180 | 4/1990 | Japan | H01R 13/639 |
| 3-39272 | 4/1991 | Japan | H01R 13/639 |

*Primary Examiner*—Paula Bradley
*Assistant Examiner*—Phuongchi Nguyen
*Attorney, Agent, or Firm*—Sughrue, Mion, Zinn, Macpeak & Seas, PLLC

[57] ABSTRACT

A lock structure of the invention includes a lock arm 9 and a cancellation arm 19 both of which are supported on a base member 7. The lock arm 9 is pivotally supported resiliently on the base member 7 through first leg portions 11, and a retaining portion 15 for engagement with a mating member is formed at a distal end 17 of the lock arm. The cancellation arm 19 is pivotally supported resiliently on the base member 7 through second leg portions 21, and one end portion of the cancellation arm extends from the leg portion 21 in a direction toward the retaining portion 17, and is connected to the lock arm 9 while the other end portion of the cancellation arm extends from the leg portion 21 in a direction away from the retaining portion 17.

9 Claims, 8 Drawing Sheets

PRIOR ART

PRIOR ART

PRIOR ART

LOCK STRUCTURE

BACKGROUND OF INVENTION

1. Field of invention

This invention relates to a lock structure for connecting two parts or members, such as connectors, together, and more particularly to a lock structure having a mechanism for canceling a locked condition.

2. Related art

FIGS. 9 and 10 show one known structure in which male and female connector housings or the like are connected together, and this connected condition is locked, and this locked condition is canceled. In this lock structure, a lock arm 37 is pivotally supported resiliently on the female connector housing 33 through a leg portion 35 at a generally central portion of the lock arm 37. A retaining portion 39 is formed at one end of the lock arm 37 while a cancellation portion 45 is provided at the other end thereof. A load is applied to the cancellation portion 45 by the finger to lift the retaining portion 39 of the lock arm 37, thereby canceling the engagement between the retaining portion 39 and a retaining portion 43 of the male connector housing 41. Such a lock structure is proposed in Japanese Utility Model Unexamined Publication Nos. 61-60482 and 3-39272. A lock structure, shown in FIGS. 11 and 12, is proposed in Japanese Utility Model Unexamined Publication No. 2-54180. In this lock structure, lock arms 51 are pivotally supported resiliently on a male connector housing 47 at their respective leg portions 49, and cancellation arms 53 are also provided on the male connector housing 47. A retaining portion 55 is formed at distal ends of the lock arms 51. The cancellation arms 53 are connected to the distal end of the lock arms 51, and extend beyond the leg portions 49 in a direction away from the retaining portion 55, and a cancellation portion 57 is formed at rear ends of the cancellation arms 53. Stopper portions 59 for preventing excessive depressing of the cancellation arms 53 are formed on the male connector housing 47. A load is applied to the cancellation portion 57 by the finger to lift the retaining portion 55 of the lock arms 51, thereby canceling the engagement between the retaining portion 55 and a retaining portion 63 of a female connector housing 61.

However, in the lock structure proposed in Japanese Utility Model Unexamined Publication Nos. 61-60482 and 3-39272, it is necessary to thicken the leg portion in order to increase the locking strength. However, if the leg portion is thickened, a large force is required for canceling the locked condition. In contrast, if it is desired to reduce the force required for canceling the locked condition, the leg portion must be thinned, and therefore the sufficient locking strength can hardly be obtained. Namely, the problem is that the increase of the locking strength is contradictory to the reduction of the force required for canceling the locked condition.

In Japanese Utility Model Unexamined Publication No. 2-54180, the cancellation arms are supported on the distal end portion (the retaining portion) of the lock arms, and therefore even when a force is applied to the cancellation arms, the retaining portion of the lock arms, in some cases, are not displaced in the canceling direction before the cancellation arms are brought into abutting engagement with the stopper portions, and therefore the canceling ability is low. Namely, the displacement of the distal end portion (the retaining portion) is not constant, but varies depending on the direction and angle of the force applied to the cancellation arms for lock-canceling purposes, and therefore the retaining portion is not displaced in the canceling direction, which results in a possibility that the locked condition can not be positively canceled.

SUMMARY OF INVENTION

It is an object of this invention to provide a lock structure in which the increase of a locking strength (enhancement of the locking strength) and the enhancement of a canceling ability (that is, the reduction of a force required for canceling a locked condition, and the positive cancellation) are compatible with each other.

The above object has been achieved by a lock structure of the invention comprising a lock arm and a cancellation arm both of which are supported on a base member; provided in that the lock arm is pivotally supported resiliently on the base member through a first leg portion, and a retaining portion for engagement with a mating member is formed at a distal end of the lock arm; and the cancellation arm is pivotally supported resiliently on the base member through a second leg portion, and one end portion of the cancellation arm extends from the second leg portion in a direction toward the retaining portion, and is connected to the lock arm while the other end portion of the cancellation arm extends from the second leg portion in a direction away from the retaining portion.

With this construction of the present invention, the above object can be achieved by the following operation.

The lock arm and the cancellation arm have their respective independent leg portions, and therefore for canceling a locked condition, the retaining portion is positively displaced about the leg portion in a canceling direction in accordance with a force applied to the cancellation arm to pivotally move the same. Therefore, the canceling ability is enhanced. The required locking strength can be obtained by thickening the leg portion of the lock arm. On the other hand, the thickness of the leg portion of the cancellation arm can be set to a desired value in view of the canceling ability and so on. Furthermore, the leg portion of the cancellation arm and the leg portion of the lock arm can be disposed respectively at different positions spaced from each other in the direction of extending of the arm. With this arrangement, the locking strength and the lock-canceling ability can be adjusted independently of each other. Namely, the enhancement of the locking strength and the enhancement of the canceling ability are compatible with each other.

For example, if the leg portion of the cancellation arm is thinned, the resistance of the cancellation arm (due to its elastic force and so on) to the pivotal movement of the lock arm is reduced, so that the force, required for canceling the locked condition, is reduced, and therefore this is desirable.

If the leg portion of the cancellation arm is disposed closer to the retaining portion than the leg portion of the lock arm is, the force, required for canceling the locked condition, is reduced because of the effect of leverage, thereby enhancing the canceling ability, and therefore this is desirable.

In the case where the lock structure of the present invention is used in a connector or the like, the lock arm, the cancellation arm, and their leg portions can be molded integrally with a connector housing, using a synthetic resin or the like, and by doing so, the lock structure of the present invention can be provided easily.

DETAILED DESCRIPTION OF PREFERRED EMBODIMENTS

Figure 1A:
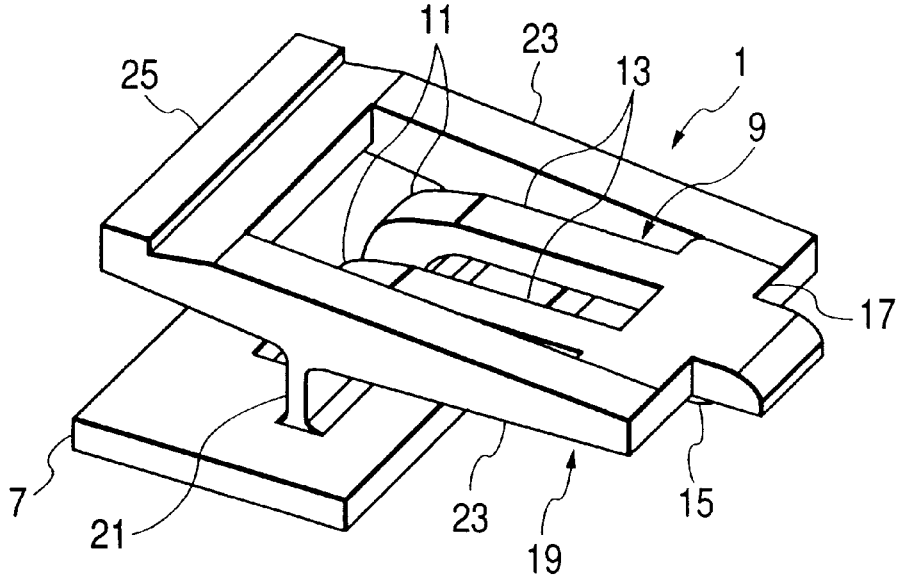
FIG. 1(*a*) is a perspective view of one preferred embodiment of a lock structure of the present invention as seen from a retaining portion-side, and FIG. 1(*b*) is a perspective view thereof as seen from a cancellation portion-side.
Figure 1B:
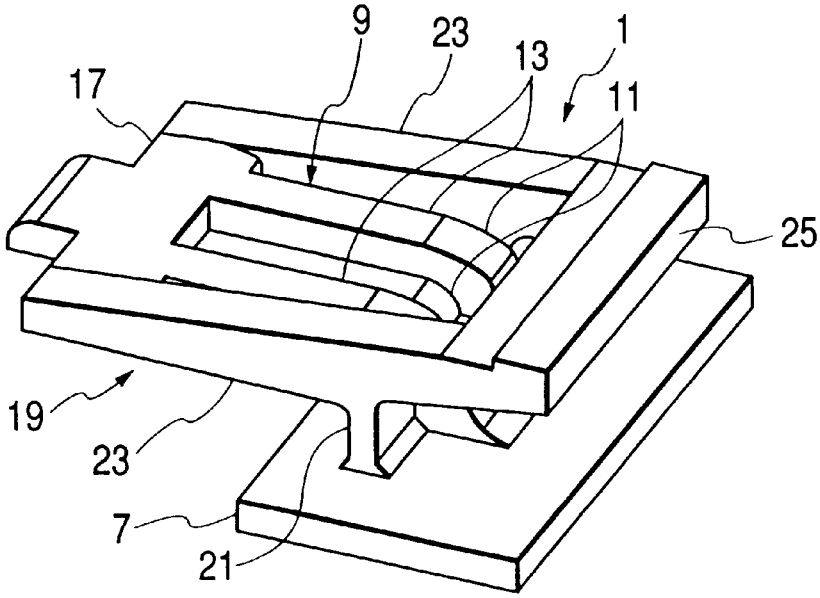
Figure 2:
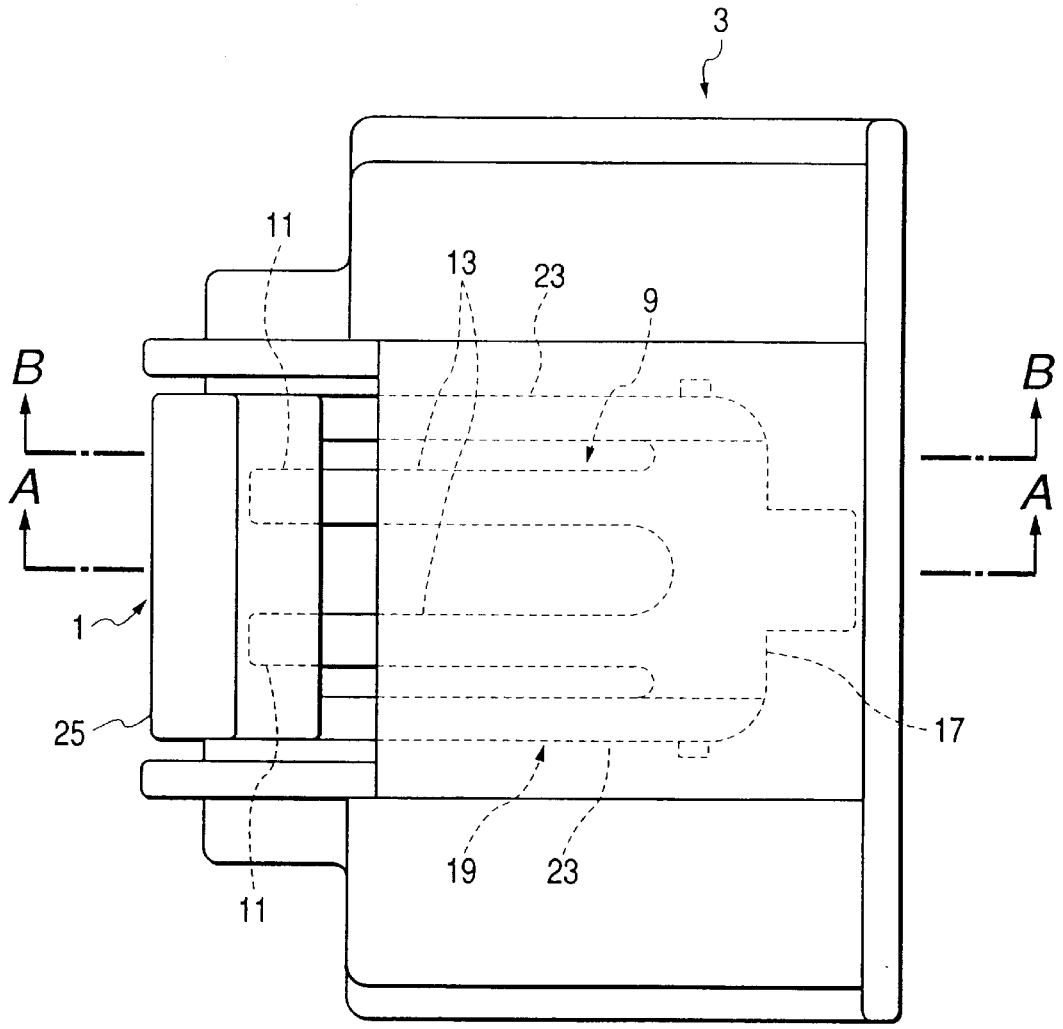
FIG. 2 is a plan view of a female connector housing.
Figure 5:
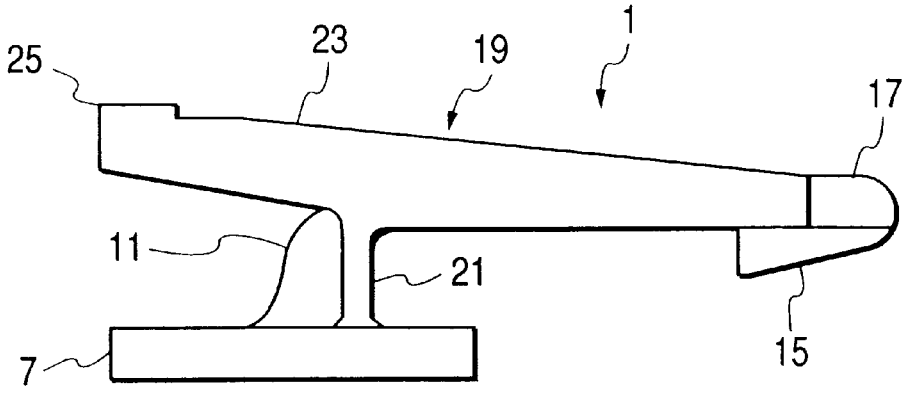
FIG. 5 is a front-elevational view of a lock portion.
Figure 6:
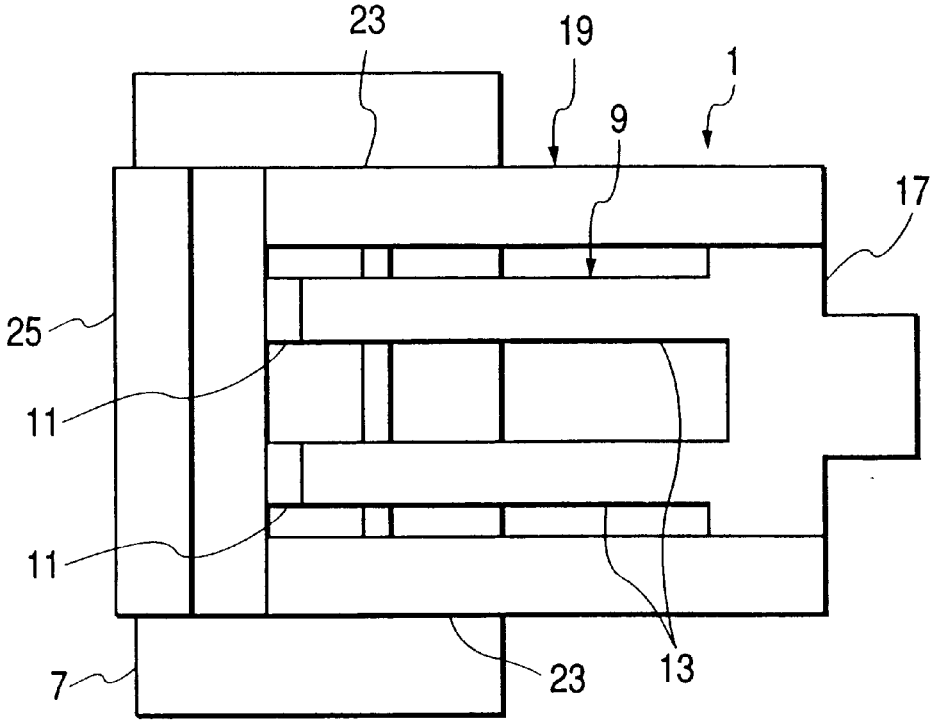
FIG. 6 is a plan view of the lock portion.
Figure 7A:
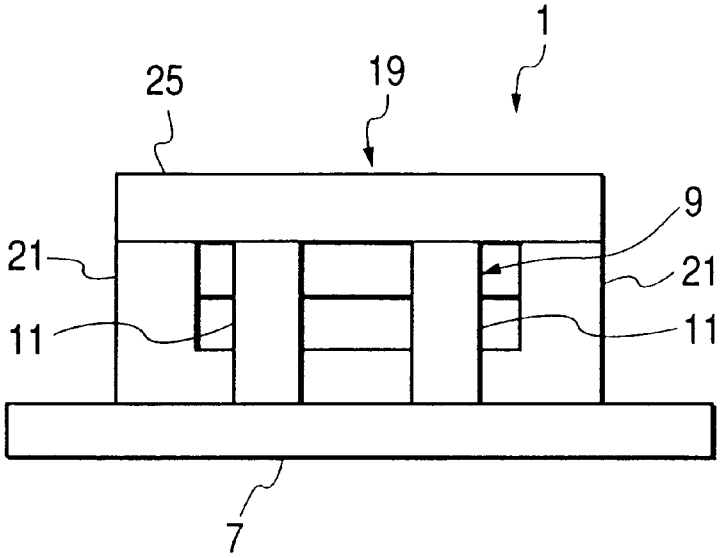
FIG. 7(*a*) is a side-elevational view of the lock portion as seen from the cancellation portion-side, and FIG. 7(*b*) is a side-elevational view thereof as seen from the retaining portion-side.
Figure 7B:
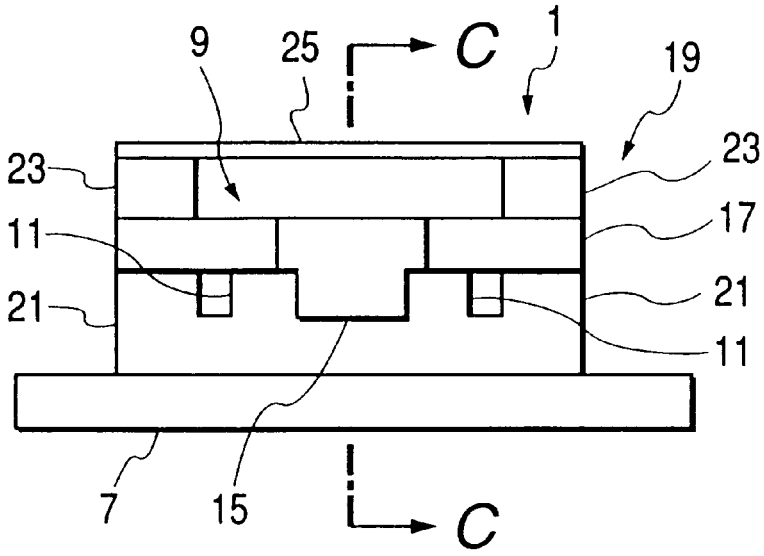
Figure 8:
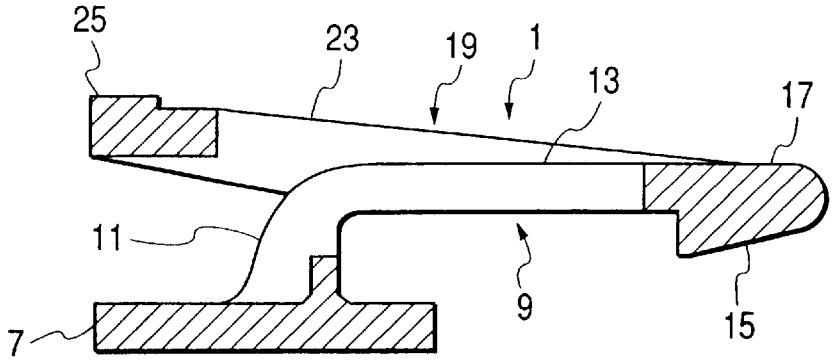
FIG. 8 is a cross-sectional view taken along the line C—C of FIG. 7.
Figure 9:
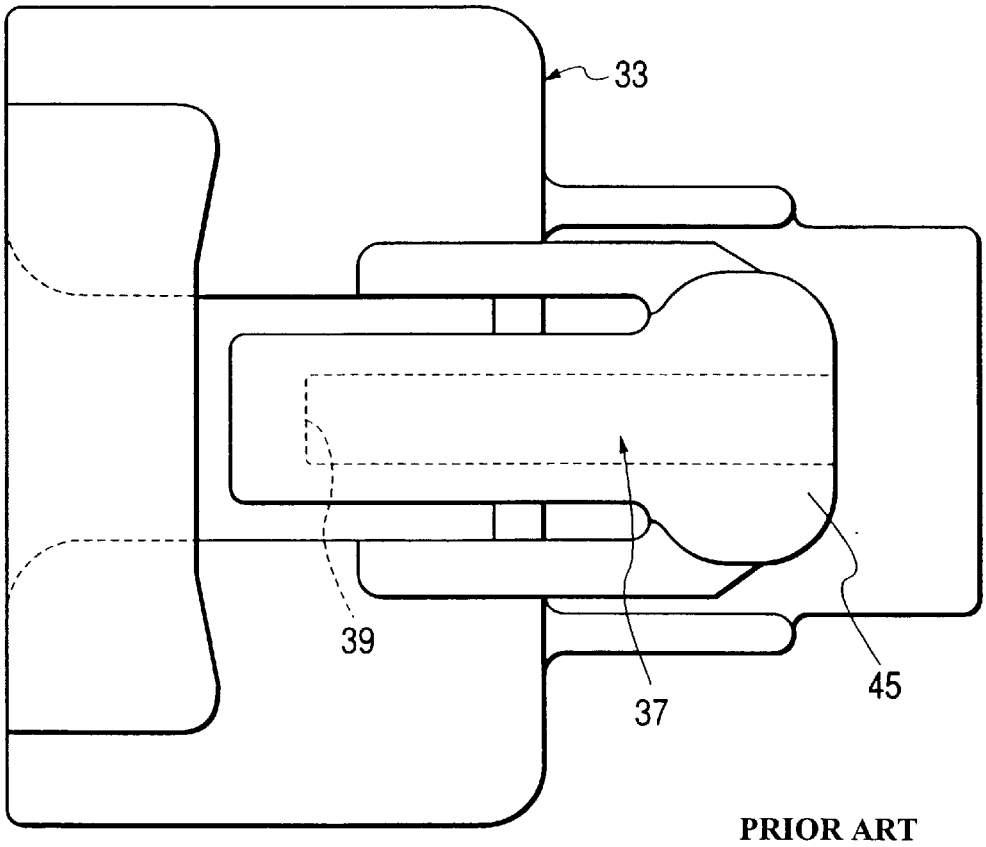
FIG. 9 is a plan view of a female connector housing having a conventional lock structure.
Figure 10:
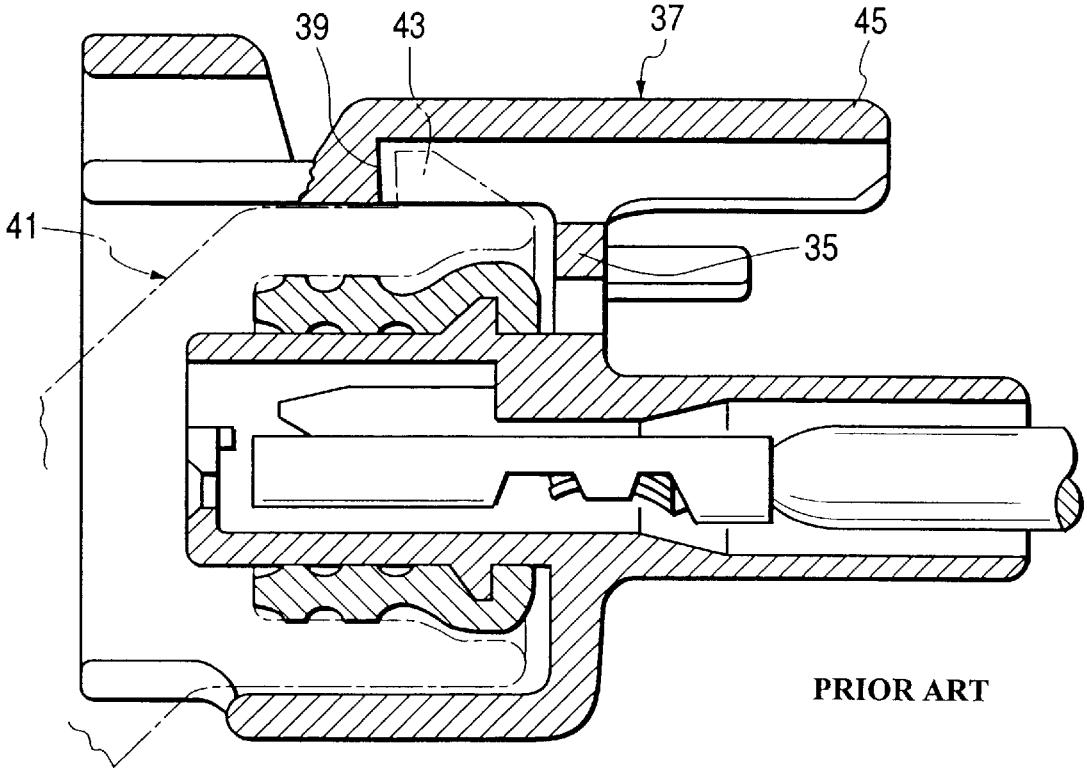
FIG. 10 is a cross-sectional view of the conventional construction of FIG. 9.
Figure 11:
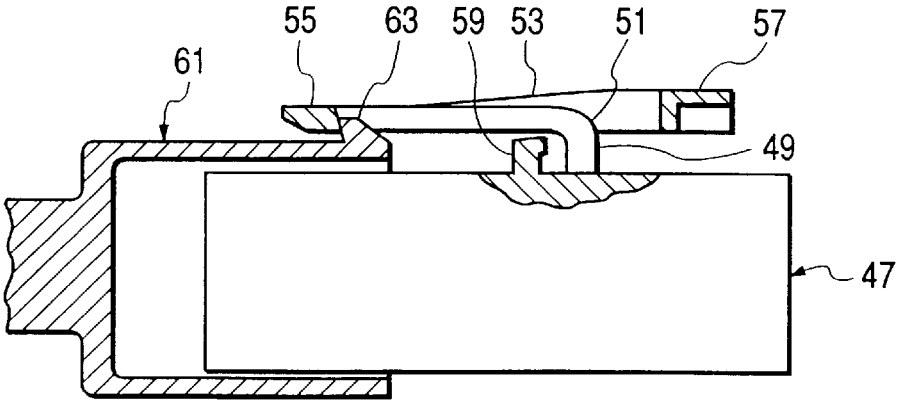
PRIOR ART FIG. 11
FIG. 11 is a cross-sectional view of a male connector housing having a conventional lock structure.
Figure 12:
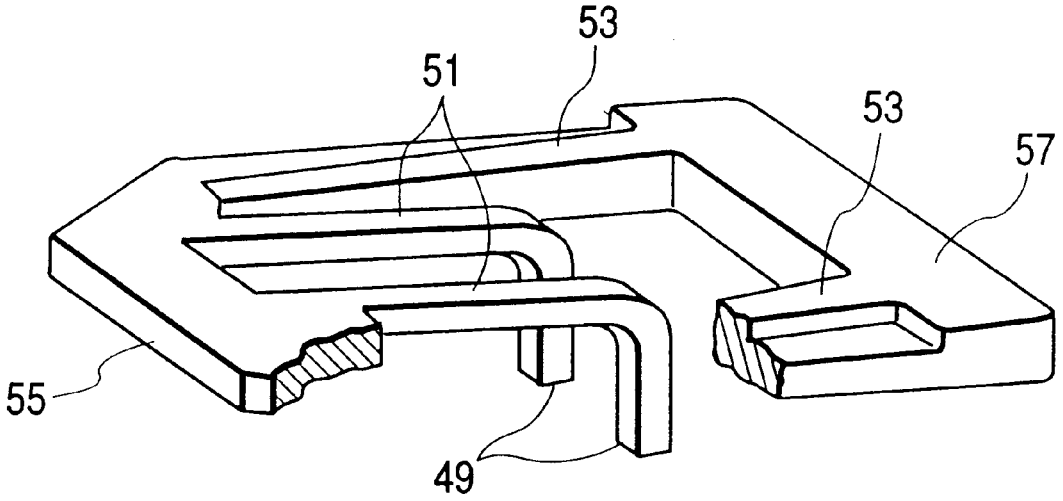
FIG. 12 is a perspective view of the conventional construction of FIG. 11.

A preferred embodiment of the present invention will now be described with reference to the drawings. One preferred embodiment of a lock structure of the invention will be described with reference to FIGS. 1 to 8. FIGS. 1(*a*) and 1(*b*) are perspective views of the lock structure. FIG. 2 is a plan view of a female connector housing, FIGS. 3 and 4 are cross-sectional views of the female connector housing, FIG. 5 is a front-elevational view of a lock portion, FIG. 6 is a plan view thereof, FIGS. 7(*a*) and 7(*b*) are side-elevational views thereof, and FIG. 8 is a cross-sectional view thereof.

Figure 3:
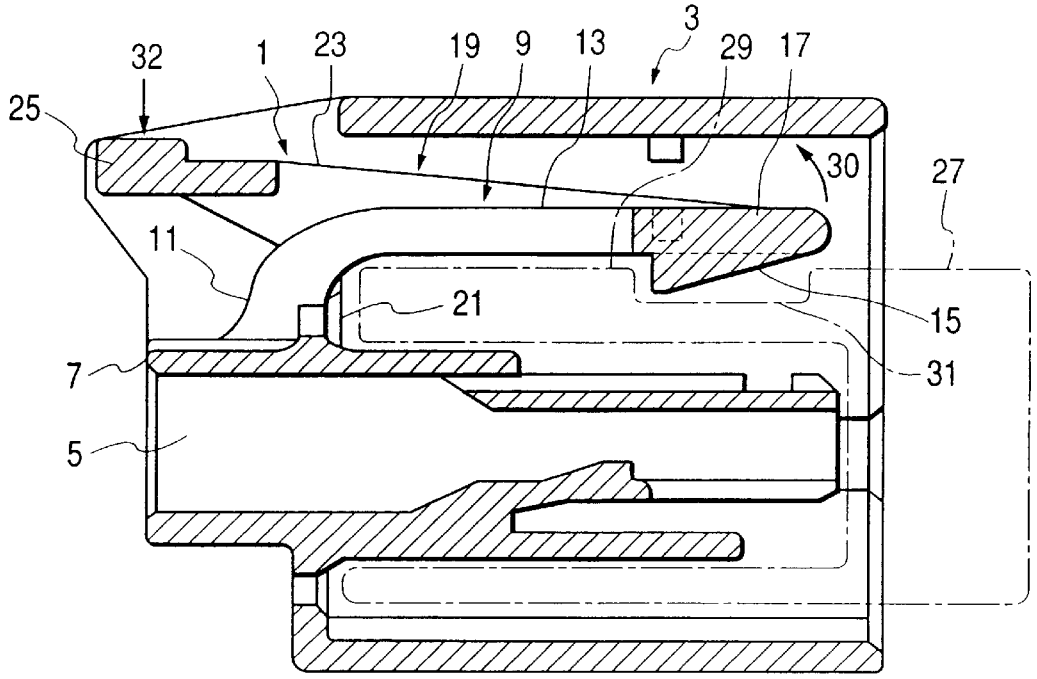
FIG. 3 is a cross-sectional view taken along the line A—A of FIG. 2.
Figure 4:
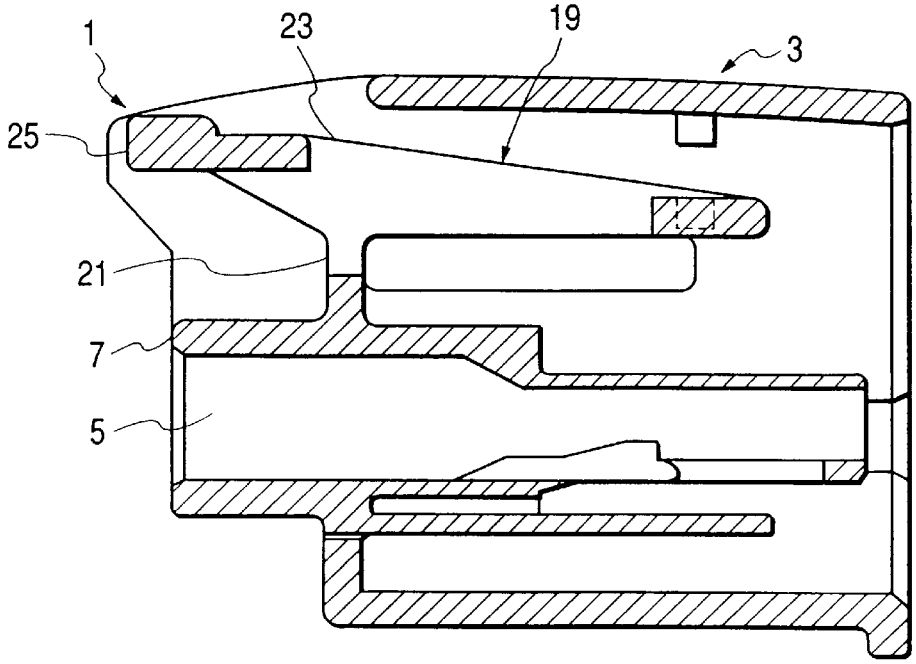
FIG. 4 is a cross-sectional view taken along the line B—B of FIG. 2.

In this embodiment, as shown in FIGS. 2 to 4, the lock portion 1, having features of the present invention, is formed integrally with the female connector housing 3 made of a synthetic resin, and more specifically this lock portion 1 is formed on an upper wall 7 of the female connector housing 3 having terminal receiving chambers 5.

As shown in FIG. 1 and FIGS. 5 to 8, a lock arm 9 includes two curved leg portions 11, formed on and extending from the upper wall 7, and two arm portions 13 extending respectively from the two leg portions 11. The arm portions 13 extend parallel to the upper wall 7 in a direction of insertion of the female connector housing 3. A retaining portion 17, having a retaining pawl 15, is formed at distal ends of the two arm portions 13, and interconnects the two arm portions 13. A cancellation arm 19 includes two leg portions 21, extending from the upper wall 7, and two arm portions 23 formed respectively on the two leg portions 21, the leg portions 21 being smaller in thickness than the leg portions 11. The two leg portions 21 are disposed adjacent to outer side surfaces of the two leg portions 11 of the lock arm 9, respectively, and are disposed generally at the same positions as those of the leg portions 11. One end portion of each arm portion 23 extends from the leg portion 21 in a direction toward the retaining portion 17 in generally parallel relation to the upper wall 7 while the other end portion of the arm portion 23 extends from the leg portion 21 in a direction away from the retaining portion 17 in generally parallel relation to the upper wall 7. The one end portion of the arm portion 23, extending toward the retaining portion 17, is connected to this retaining portion 17. A cancellation portion 25 is formed at the other end portions of the two arm portions 23, extending away from the retaining portion 17, and interconnects the two arm portions 23.

The operation of the lock structure of the above construction, as well as the features of the present invention, will now be described.

In this embodiment, the female connector housing 3 and a mating male connector housing 27 are connected together as shown in FIG. 3. During the time when the female connector housing 3 and the male connector housing 27 are connected together, the retaining pawl 15 is lifted by an upper surface 29 of the male connector housing 27. As a result, the arm portions 13 and retaining portion 17 of the lock arm 9 are pivotally moved about the leg portions 11 in a direction of arrow 30. When the connection between the two connectors is completed, the retaining pawl 15 is engaged in a retaining hole 31 in the male connector housing 27, thereby locking this connected condition. For canceling the locking of the connector-connected condition, the cancellation portion 25 is depressed in a direction of arrow 32. Therefore, in accordance with the force, applied to the cancellation portion 25, the cancellation arm 19 is pivotally moved about the leg portions 21 to positively lift the retaining portion 17 in the direction of arrow 30, so that the retaining pawl 15 is disengaged from the retaining hole 31, thereby canceling the locked condition.

In this embodiment, the leg portions 11 of the lock arm 9 are sufficiently thick to achieve the required locking strength. On the other hand, the leg portions 21 of the cancellation arm 19 are so thin that the resistance of the leg portions 21 (due to their elastic force and so on) to the pivotal movement of the cancellation arm 19 can be reduced, thereby reducing the force required for canceling the locked condition.

Thus, the cancellation arm 19 has the leg portions 21, and therefore even if the force is applied to the cancellation portion 25 in any direction and at any angle, the retaining portion 17 is positively displaced in the lock-canceling direction 30 in accordance with the force applied to the cancellation portion 25. Namely, the locked condition can be positively canceled, and therefore the canceling ability is enhanced. And besides, the thickened leg portions 11 of the lock arm 19 increases the locking strength, and therefore the locking ability is enhanced. Namely, the lock arm 9 has their own leg portions 11 while the cancellation arm 19 has their own leg portions 21, and therefore the enhancement of the locking strength and the enhancement of the canceling ability are compatible with each other.

In a conventional construction in which although a lock arm and a cancellation arm are provided, the cancellation arm has no leg portion, the cancellation arm is supported only at a retaining portion, that is, at a distal end of the lock arm. Therefore, if there is applied a force tending to lift the cancellation arm (for example, when forcibly pulling a wire harness interposed between a connector housing and the cancellation arm, or when a force is applied laterally to the cancellation arm), the cancellation arm can be easily curled upwardly, or can be twisted laterally, so that the cancellation arm may be damaged. In the present invention, however, even when an upwardly-lifting force or a laterally-twisting force is applied to the cancellation arm, the cancellation arm will not easily be curled upwardly, or will not be laterally twisted since the leg portions 21 support the cancellation arm 19, and therefore the cancellation arm will not be damaged.

In this embodiment, the locking strength is adjusted by the thickness of the leg portions 11 of the lock arm 9 and the thickness of the leg portions 21 of the cancellation arm 19. However, the locking strength, as well as the force required for canceling the locked condition, can be adjusted by the effect of leverage, in which case the position of the leg portions 11 of the lock arm 9, as well as the position of the leg portions 21 of the cancellation arm 19, is changed in the direction of extending of the arm. For example, for increasing the locking strength, the leg portions 11 of the lock arm 9 are disposed closer to the retaining portion 17. On the other hand, for reducing the canceling force, the leg portions 21 of the cancellation arm 19 are disposed closer to the retaining portion 17 than the leg portions 11 of the lock arm 9 are.

In this embodiment, although the lock portion 1 is molded integrally with the female connector housing 3, the lock arm 9, including the arm portions 13 and the leg portions 11, and the cancellation arm 19, including the arm portions 23 and the leg portions 21, can be provided as a separate part.

The lock arm 9 includes the two arm portions 13 and the two leg portions 11, and the cancellation arm 19 includes the two arm portions 23 and the two leg portions 21. However, each of the lock arm and the cancellation arm can include one or more than two arm portions and leg portions.

In this embodiment, although the lock portion 1 is provided on the female connector housing, the lock portion 1 can be provided on the male connector housing.

In this embodiment, although the lock portion 1 is used for locking the connected condition of the connectors, the lock structure of the present invention is not limited to this embodiment, but can be used for locking a connected condition of two parts or two members.

In the present invention, the enhancement of the locking strength and the enhancement of the canceling ability are compatible with each other.

What is claimed is:

1. A connector with a lock structure comprising:

a connector housing:

a lock arm and a cancellation arm both of which are supported on a base member of said connector housing, said lock arm being pivotally supported resiliently on said base member through a first leg portion, said lock arm including:

a retaining portion for engagement with a mating member, said retaining portion being formed at a distal end of said lock arm; and said cancellation arm being pivotally supported resiliently on said base member through a second leg portion, and one end portion of said cancellation arm extending from said second leg portion in a direction toward said retaining portion, and being connected to said lock arm while the other end portion of said cancellation arm extending from said second leg portion in a direction away from said retaining portion.

2. A lock structure comprising:

a lock arm and a cancellation arm both of which are supported on a base member, said lock arm being pivotally supported resiliently on said base member through a first leg portion, said lock arm including:

a retaining portion for engagement with a mating member, said retaining portion being formed at a distal end of said lock arm; and said cancellation arm being pivotally supported resiliently on said base member through a second leg portion, and one end portion of said cancellation arm extending from said second leg portion in a direction toward said retaining portion, and being connected to said lock arm while the other end portion of said cancellation arm extending from said second leg portion in a direction away from said retaining portion.

3. A lock structure according to claim 1, in which said lock arm, said cancellation arm and said base member are molded integrally with one another.

4. A lock structure according to claim 1, in which said second leg portion is disposed closer to said retaining portion than said first leg portion.

5. A lock structure according to claim 4, in which said lock arm, said cancellation arm and said base member are molded integrally with one another.

6. A lock structure according to claim 1, in which said second leg portion is smaller in thickness than said first leg portion.

7. A lock structure according to claim 6, in which said lock arm, said cancellation arm and said base member are molded integrally with one another.

8. A lock structure according to claim 6, in which said second leg portion is disposed closer to said retaining portion than said first leg portion.

9. A lock structure according to claim 8, in which said lock arm, said cancellation arm and said base member are molded integrally with one another.

* * * * *